US006168148B1

(12) United States Patent
Bechler et al.

(10) Patent No.: US 6,168,148 B1
(45) Date of Patent: Jan. 2, 2001

(54) SHEET SEPARATING DEVICE

(75) Inventors: Russel Alan Bechler, Bellbrook, OH (US); Richard B. Hawkes, Bethlehem, PA (US)

(73) Assignee: Heidelberger Druckmaschinen AG, Heidelberg (DE)

( * ) Notice: Under 35 U.S.C. 154(b), the term of this patent shall be extended for 0 days.

(21) Appl. No.: 09/272,967

(22) Filed: Mar. 19, 1999

(51) Int. Cl.[7] ..... B65H 3/08; B65H 3/12
(52) U.S. Cl. ..... 271/90; 271/95; 271/107
(58) Field of Search ..... 271/5, 10–15, 271/90–31.1

(56) References Cited

U.S. PATENT DOCUMENTS 3,695,606 * 10/1972 Wirz ..... 271/26 R X
3,980,293 * 9/1976 Shelmire ..... 271/93
3,988,016 10/1976 Merker et al. .
4,148,473 * 4/1979 Johnson ..... 271/20 X
4,358,101 * 11/1982 Janecek et al. ..... 271/12
5,284,334 * 2/1994 Yamamoto ..... 271/107 X
5,308,055 * 5/1994 Binnen ..... 271/15
5,738,347 * 4/1998 Tognino ..... 271/106 X
5,895,037 * 4/1999 Baureis et al. ..... 271/92

FOREIGN PATENT DOCUMENTS 976134 3/1963 (DE) .

* cited by examiner

*Primary Examiner*—H. Grant Skaggs
*Assistant Examiner*—Kenneth W Bower
(74) *Attorney, Agent, or Firm*—Herbert L. Lerner; Laurence A. Greenberg; Werner H. Stemer

(57) ABSTRACT

The apparatus for separating a flat product from a pile of flat products, has a sucker mechanism with an upper and a lower part. The upper part is connected to a first link joint of a central lever and the lower part is connected to a second link joint of the central lever. The central lever is rotatable about an axis which extends through the central lever. The axis is movable along the central lever, in order to change the position of the pivot point of the central lever.

10 Claims, 4 Drawing Sheets

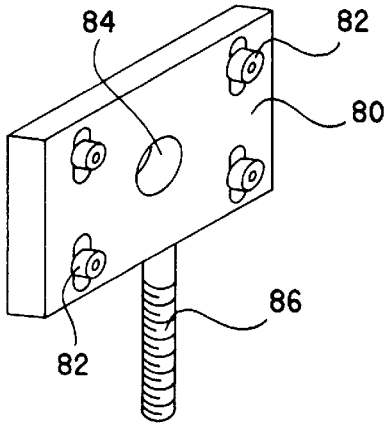
Fig.3a
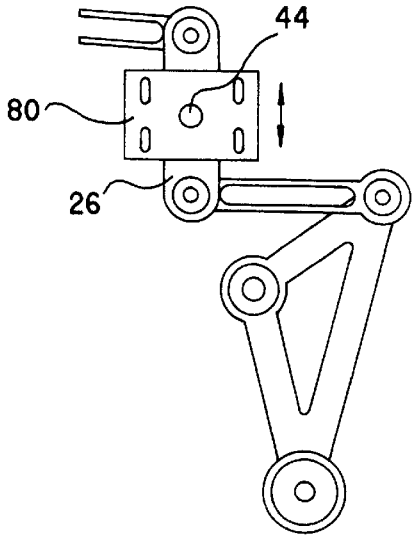
Fig.3b
Fig.4
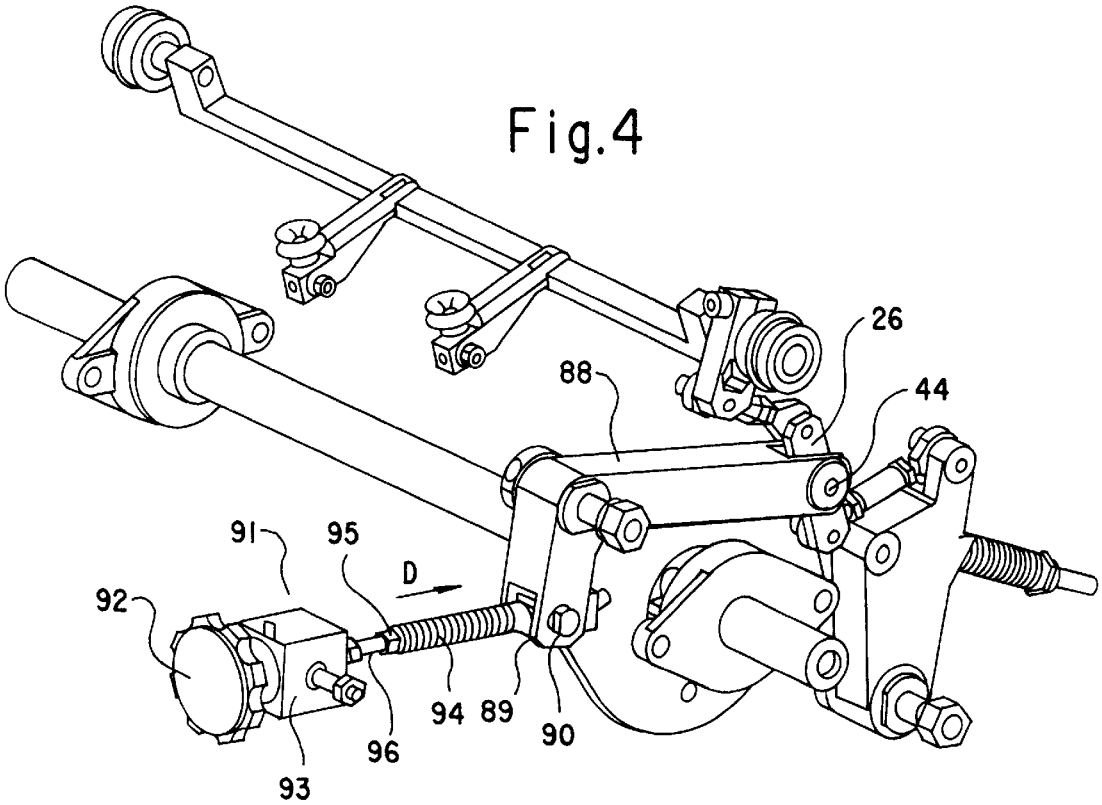

SHEET SEPARATING DEVICE

BACKGROUND OF THE INVENTION

FIELD OF THE INVENTION

This invention relates to an apparatus for separating flat products from a pile of flat products, the apparatus comprising a sucker mechanism having an upper and a lower part.

In the technology of building books, including booklets, magazines, periodicals, and the like, the use of collating systems is well known. Those systems typically have a transporting device on which individual flat products, such as signatures or sheets, are gathered to build a book-block set, which then is finished and bound. Typically, a number of feeders are arranged along the transporting device, each of the hoppers comprising a feeding mechanism for feeding an individual flat product from a pile of signatures onto the transporting device, in order to gradually build up the book-block set or to insert a supplement sheet into a pocket of a pocket feeder or into a newspaper arranged in the pocket. Such feeding mechanisms typically employ a sheet-separating device for separating a sheet or other single flat product from a pile of flat products which is arranged in each hopper. The single flat products are drawn from the pile at its bottom end.

A sheet-separating device of this kind is known, for example, from U.S. Pat. No. 3,988,016. That document discloses a high-speed paper inserting apparatus for insertion of supplements into newspapers. The inserts are placed to form a stack and a vacuum gripping member grips the lowermost insert from the stack and carries it to a pair of nip rollers which transport the insert to an opened newspaper. A single sheet requires a different sucker stroke than a 120 page or pre-inserted section. The different sucker motion requirements are due to the way the sheets or sections have to be positioned and controlled for proper singulation. Generally, the bottom of the stack of heavy sections is elevated to eliminate followers. This is accomplished by repositioning the lift hook and restrictors. When these adjustments are made the vacuum cup motion must be changed. To raise the sucker motion so that it properly engages the pile requires the sucker bar to stroke through a greater angle. The sucker adjustment is very critical. It is desirable to make fine adjustments on the fly. The "on the fly" adjustment also facilitates faster initial set-up. It is therefore necessary that the maximum upward position of the sucker cup for each type of section at any time during a production run. Overdriving the sucker into single sheets and light sections will cause bouncing of the pile and evasive feeding/singulation.

To eliminate these problems, some efforts have previously been made to design a lifting sucker and a lifting sucker drive having means for adjusting the maximum position of the sucker cup. German patent DE 976 134 discloses a suction device having a lifting sucker and a lifting sucker drive. As the sucker separates the individual signatures from the top of a pile of signatures, the maximum lower position of the lifting sucker is adjusted by the drive including adjusting means. This is achieved by changing the angular position of two lever arms which are coupled to each other by a cam lever.

SUMMARY OF THE INVENTION

It is an object of the present invention to improve the sucker position of the sheet-separating device. It is further an object to improve the sealing effect of vacuum applied to the lowermost product of a pile of products to be fed from the pile, especially to the grippers of a gripper drum which takes over the flat products for further movement.

Briefly summarized, according to one aspect of the present invention an improved apparatus for separating flat product from a pile of flat products is suggested. The apparatus comprises a sucker mechanism having an upper and a lower part and a central lever with an axis extending through said lever, said axis being movable along said central lever. The central lever is rotatable about the axis and has a first and a second end and a first link located on the first end and a second link located on the second end, the upper part of the sucker mechanism being coupled to the first link and the lower part being coupled to the second link.

Providing a movable axis which extends through the central lever makes it possible to adjust the maximum upward position of the sucker which is the position that requires adjustment depending on the product to be sucked. As some products require an adjustment of the sucker cups to a higher or lower position to better achieve a vacuum seal, the present invention provides an apparatus which meets this demand easily. Due to the geometry of the design and the individual linkages being coupled to other linkages, the maximum height of the cups is adjustable without influencing the maximum lower position of the cups. It is therefore possible to simply adjust the maximum upper position of the vacuum cups by moving the axle which corresponds to the pivot point of the central lever. Shortening the setup time by an adjustment without tools is a further advantage of the present invention, as well as the chance to adjust the cups "on the fly".

Other features which are considered as characteristic for the invention are set forth in the appended claims.

Although the invention is illustrated and described herein as embodied in a sheet separating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3*a* is a schematic perspective view of an adjustment box,

FIG. 3*b* is a schematic side view of the sheet separating device according to the present invention, having an adjustment box, FIG. 4 is a schematic perspective view of a further embodiment of a sheet-separating device according to the present invention.

DESCRIPTION OF THE PREFERRED EMBODIMENTS

Figure 1:
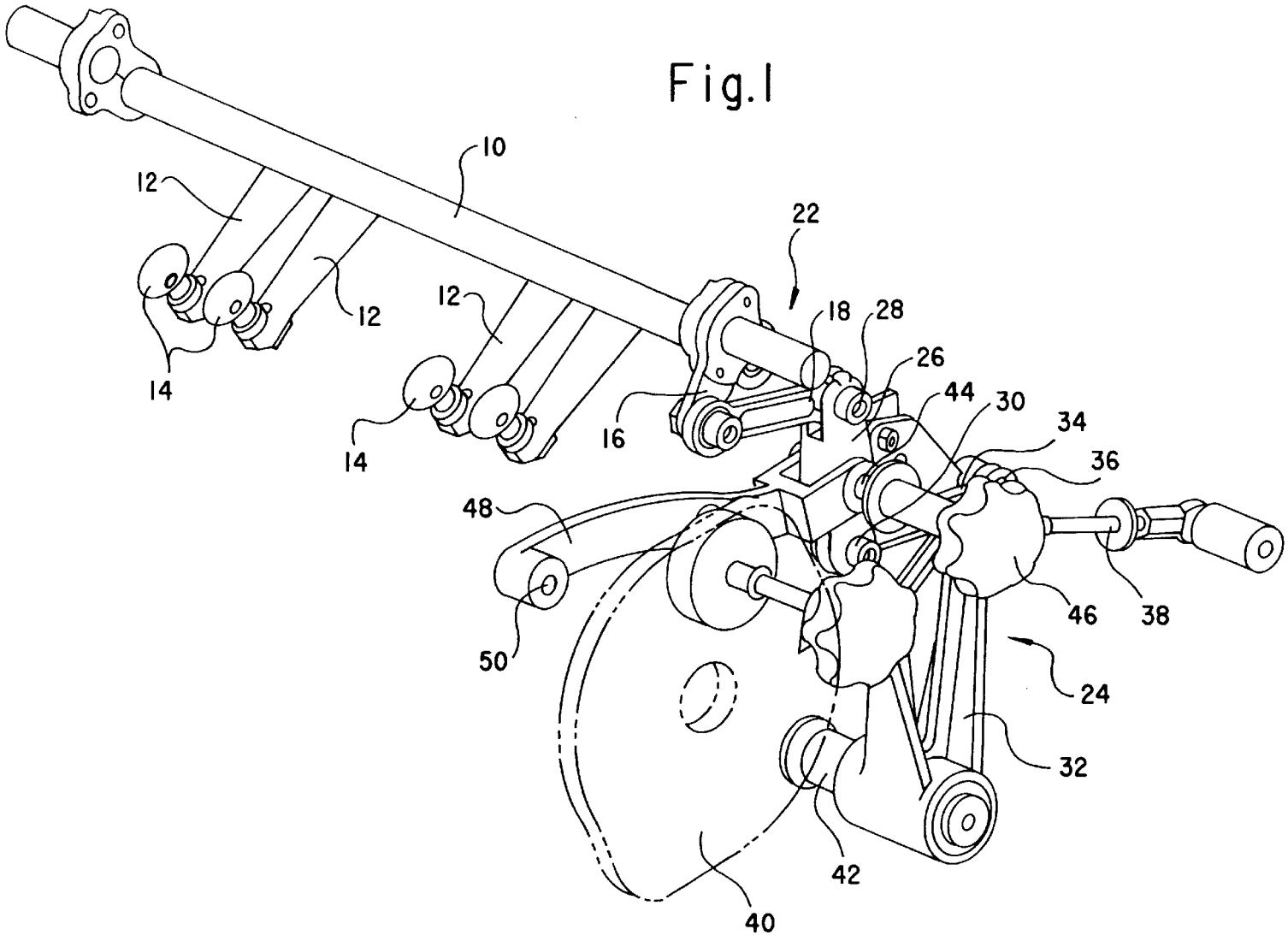
FIG. 1 is a schematic perspective view of a first embodiment of a sheet-separating device according to the present invention.

Referring to FIG. 1 a perspective view of a sheet-separating apparatus according to the present invention is shown. A number of sucker arms 12 are coupled to a supporting shaft 10. On each of the sucker arms 12 a sucker cup 14 is mounted, the mounting position of each of the sucker cups 14 being adaptable individually and independently from each other. The supporting shaft 10 is connected to an upper link lever 18 by an upper lever 16. The components mentioned above form an upper part 22 of the sucker mechanism, where this upper part 22 is coupled to a central lever 26. The central lever 26 has a first end with a first link joint 28 to which the upper link lever 18 is connected. The separating apparatus furthermore includes a lower part 24 of the sucker mechanism which includes a lower lever 32, preferably of triangular shape, and a lower link lever 34 which is connected to the lower lever 32 at a link joint 36. The lower part of the separating apparatus is coupled to the central lever 26 at a second link joint 30 which is provided on a second end of the central lever 26. A biasing element 38, which may be a compression spring or a pneumatic actuator, presses the lower part of the separating apparatus 24 against a cam 40 having a cam follower 42 (FIG. 2) which is in close contact with the cam. An axis 44 extends through that central lever 26 and may be secured to and released from the central lever by turning a knob 46.

It is possible to change the position of the axis 44 with respect to the first and second link joint 28 and 30 by moving an adjustment link 48 up and down, i. e. in the direction of the first link joint 28 or the second link joint 30. The adjustment joint comprises two ends, the first end being secured to the axis 44 and the second end being mounted on a fixed part of the separating apparatus, for example a frame, in a manner, so that the adjustment link 48 is able to rotate about its second end 50.

Figure 2:
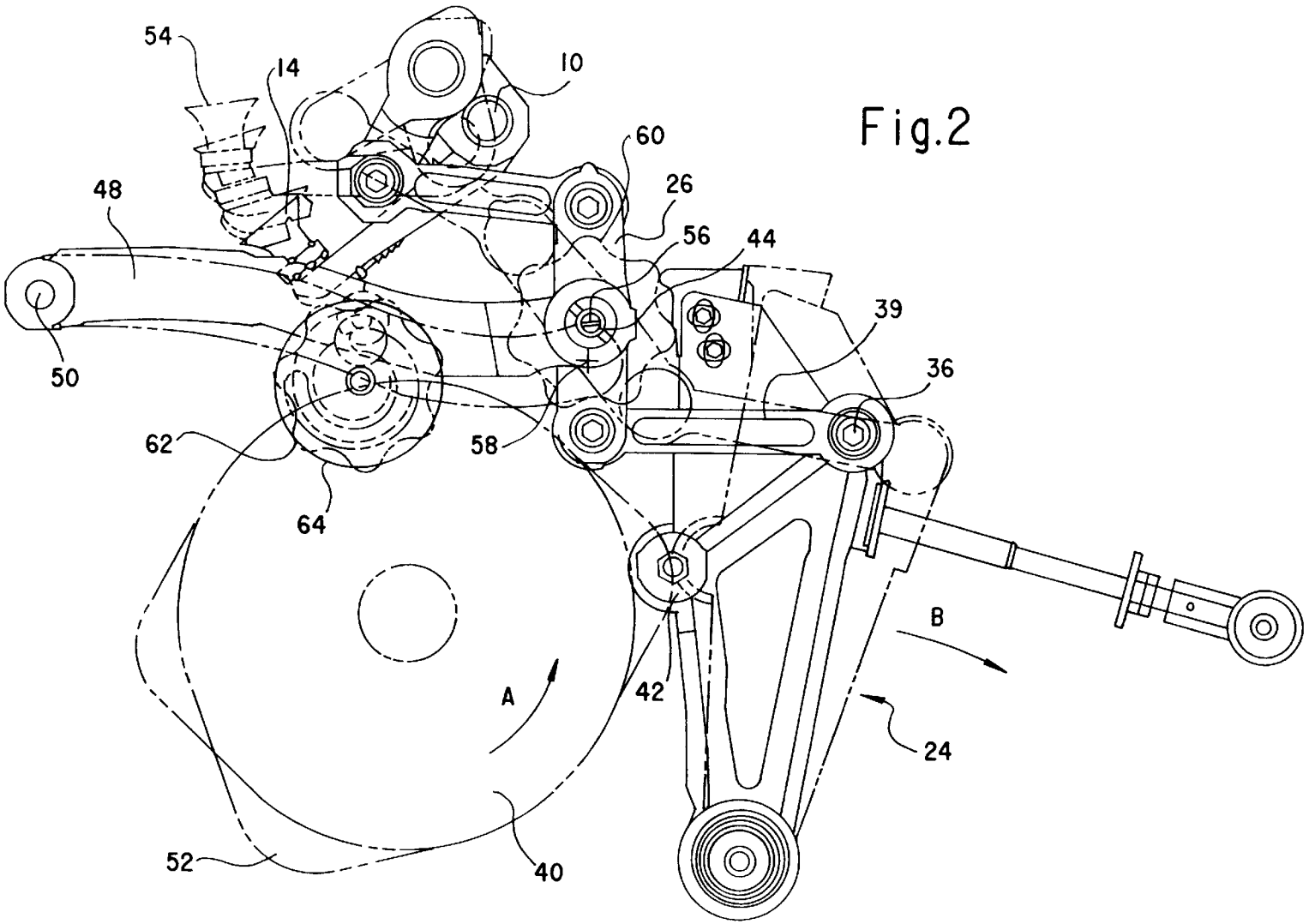
FIG. 2 is a schematic side view of a first embodiment of the sheet separating device according to the present invention.

Referring to FIG. 2, the function of the separating apparatus is shown in more detail. A cam 40 rotates in the direction indicated by the arrow "A". The cam has a projecting portion 52. As long as the projecting portion 52 is not in touch with the cam follower 42, the lower part of the separating apparatus 24 is not deflected and, due to the geometry and the special design of the individual linkages, the sucker cup 14 is in its lower position. Upon further rotation of the cam 40 the projecting portion 52 of the cam 40 contacts the cam follower 42 and initiates the movement of the lower part of the separating apparatus into the direction indicated by the arrow "B", until it reaches a position indicated by the dotted lines. As a consequence, the central lever 26 rotates and, as the upper part of the separating apparatus is coupled to the central lever, the sucker cup 14 moves into its maximum upper position 54.

The maximum upper position 54 of the sucker cup depends on the position of the pivot point given by the center of the axis 44. In order to change this maximum upper position of the sucker, the position of the axis 44 may be changed between an up-position 56 and a down position 58. An adjustment is accomplished by moving up or down the axis 44 within the limits of the up-position 56 and the down-position 58. This adjustment may be done by loosening a locking knob 60 and turning an adjustment knob 62 which in turn rotates a spiral-grooved cam 64 that carries the adjustment linkage 48 up and down. After adjustment the locking knob 60 is tightened again.

In a further embodiment of the invention, it is possible to adjust the pivot point on a central lever 26 which is defined by the center of the axis 44 by moving an adjustment box 80, which is shown in more detail in FIGS. 3*a* and 3*b*. The adjustment box is mounted on a box shaft 86 and comprises fixing means such as fixing screws 82 for fixing the adjustment box in a definite position with respect to the central lever 26. The adjustment box comprises a center hole 84 where the axis 44 extends through the hole. By loosening the fixing screws 82 it is possible to move the adjustment box 80 up and down along the box shaft 86 and thereby to adjust the axis 44 in a desired position, in order to change the pivot point of the central lever 26.

In a further embodiment, shown in FIG. 4, the adjustment of the pivot point of the center lever 26 is achieved by rotating an angle having a first 89 and second 87 lever around a shaft 90 extending through a hole being arranged in the corner of the angle lever 88. Preferably, the angle lever 88 is rotated about the shaft 90 by pressing the first leg 89 of the lever 88 in the direction of the axis 44 which in turn causes the axis 44 to move upwardly. Accordingly the axis 44 moves downwardly when the first leg 89 of the angle lever 88 is drawn in a direction away from the axis 44. Although, the first leg of the lever 88 can be moved in a direction to and away from the axis 44 by any suitable means, the movement preferably is done by a spring adjustment device 92. The spring adjustment device 92 comprises a rod 96, extending through the hole of the spring 94 and an adjustment knob 92.

By turning the knob 92, an adjustment screw located inside the box 93 is rotated and moves the rod 96 into the direction of the axis 44, indicated by the arrow D. This movement in turn compresses the spring 94 which is clamped between a screw 95 and the first leg 89 of the angle lever 88. This increases the pressure of the spring 94 against the first leg of the lever 89 and, as a consequence, causes the angle lever 88 to rotate about the shaft 90 and to move the axis 44 upwardly. By turning the knob 92 in the opposite direction, the spring 94 decreases in compression, the angle lever 88 rotates around the shaft 90 in the opposite direction and, as a consequence, the axis 44 moves downwardly again.

Figure 5:
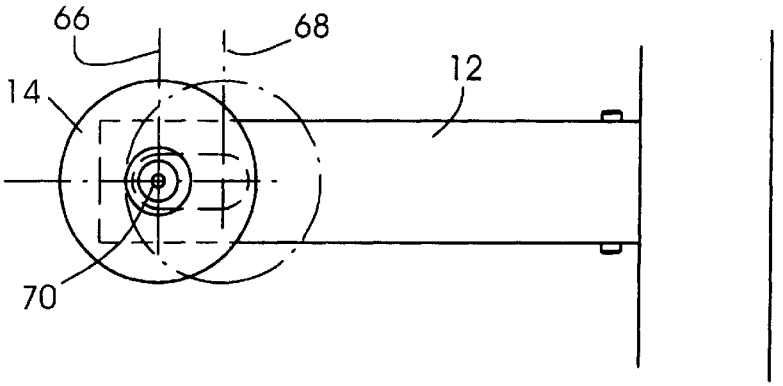
FIG. 5 is a schematic view of the sucker mechanism.

In a further embodiment of the invention, the position of the sucker cups 14 may be changeable with respect to the sucker arm 12, which is schematically shown in FIG. 5. Depending on the folded edge and the kind of the flat product to be fed from the pile of flat products, the sucker cups 14 may be adjusted with respect to the position of the sucker arm 12. This adjustment is necessary, as a thin product has a sharp fold whereas a thick product has a more round and more soft fold, which determines whether the cups need to touch the products in different places. This place may be a different one for every sucker cup of the separating apparatus. It is therefore advantageous to provide means for changing the relative position of the sucker cup to the sucker arm, so that the position of the center of the sucker cup 70 may be changed between an outer position 66 and an inner position 68.

Figure 6:
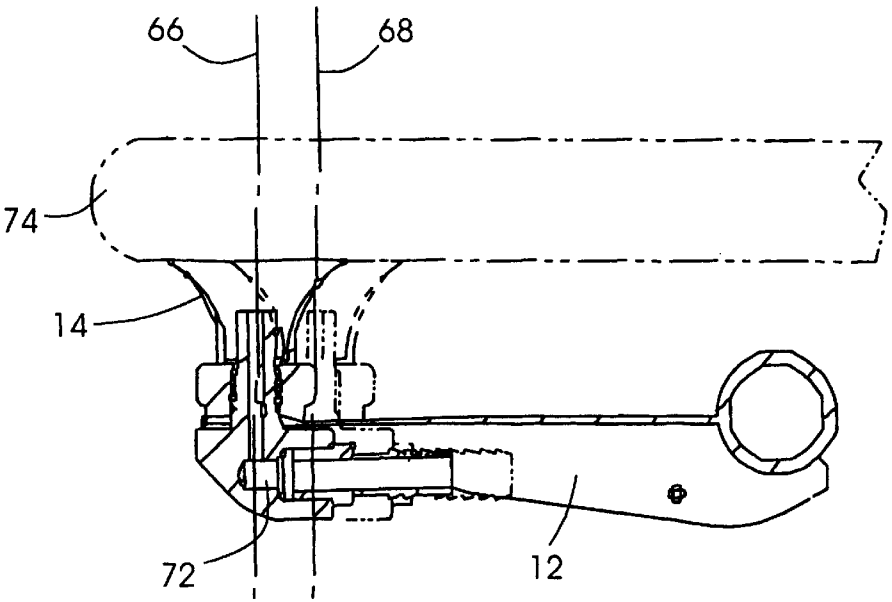
FIG. 6 depicts the adjustment mechanism of the sucker cup.

As shown in greater detail in FIG. 6, this adjustment can be done by an adjustment screw 72 which changes the position of the sucker cup 14 upon turning between the outer position 66 and the inner position 68. Therefore, the position of each individual sucker cup 14 can be changed with respect to the folded edge of a product 74. As a consequence, it is possible to move the sucker cup 14 closer to the folded edge of the product 74 when the product is thin, and to change the position of the sucker cup 14 away from the folded edge of the product 74, i. e. from its folded edge, so that the cup would not role around the folded edge and thereby break the vacuum seal. With this individual adjustment even a more irregularly shaped product 74 can be accommodated, when the folded edge of the product is not in the form of the usually sharp straight line.

It will of course be understood that the present invention has been described above only by way of example and that modifications of details can be made within the scope of the invention.

We claim:

1. Apparatus for separating a flat product from a pile of flat products, the apparatus comprising a sucker mechanism including an upper and a lower part, a central lever and an axis extending through said central lever and being movable along said central lever, said central lever being rotatable about said axis and having a first and second end and a first link joint located on said first end and a second link joint located on said second end, said upper part of said sucker mechanism being coupled to said first link joint and said lower part of said sucker mechanism being coupled to said second link joint.

2. The apparatus according to claim 1, wherein said upper part of said sucker mechanism comprises a supporting shaft and a plurality of sucker arms and sucker cups, one plurality of said sucker cups being mounted at a predetermined position on one of said sucker arms and each of said sucker arms being coupled to said supporting shaft.

3. Apparatus according to claim 2, wherein each of said sucker arms comprises adjustment means for adjusting said predetermined position of said sucker cups.

4. The apparatus according to claim 1, which further comprises means for fixing said axis in a plurality of fixed positions along said central lever.

5. The apparatus according to claim 4, which further comprises an adjustment link for moving said axis to one of said plurality of fixed positions.

6. The apparatus according to claim 5, which further comprises a spiral-grooved cam and an adjustment knob for rotating said spiral-grooved cam, wherein said adjustment link is in close contact with said spiral-grooved cam for moving the adjustment link into different adjustment positions.

7. The apparatus according to claim 4, which further comprises an adjustment box having a center hole and fixing screws for adjusting the position of the box relative to said central lever.

8. The apparatus according to claim 5, wherein said adjustment link is an angle lever, being formed with a hole in the corner of the lever legs and a shaft extending through said hole, wherein said angle lever is rotatable about said shaft extending through said hole.

9. The apparatus according to claim 8, said apparatus further comprising adjustment means for rotating said angle lever around said shaft extending through said hole formed in said angle lever.

10. The apparatus according to claim 9, wherein said adjustment means is a spring adjustment device comprising a spring, a rod extending through said spring, and a second adjustment knob for moving said rod relative to said angle lever and thereby changing a state of compression of said spring.

* * * * *